US010472725B2

(12) United States Patent
Simakov et al.

(10) Patent No.: US 10,472,725 B2
(45) Date of Patent: Nov. 12, 2019

(54) METHOD FOR CONTROLLING AN ALUMINA FEED TO ELECTROLYTIC CELLS FOR PRODUCING ALUMINUM

(71) Applicant: United Company RUSAL Engineering and Technology Centre, LLC, Krasnoyarsk (RU)

(72) Inventors: Dmitriy Aleksandrovich Simakov, Krasnoyarsk (RU); Aleksandr Olegovich Gusev, Krasnoyarsk (RU); Kirill Borisovich Bakin, Krasnoyarsk (RU)

(73) Assignee: UNITED COMPANY RUSAL ENGINEERING AND TECHNOLOGY CENTRE LLC, Krasnoyarsk (RU)

( * ) Notice: Subject to any disclaimer, the term of this patent is extended or adjusted under 35 U.S.C. 154(b) by 158 days.

(21) Appl. No.: 15/320,233

(22) PCT Filed: Jun. 19, 2014

(86) PCT No.: PCT/RU2014/000443

§ 371 (c)(1),
(2) Date: Dec. 19, 2016

(87) PCT Pub. No.: WO2015/194985

PCT Pub. Date: Dec. 23, 2015

(65) Prior Publication Data

US 2017/0145574 A1 May 25, 2017

(51) Int. Cl.
*C25C 3/20* (2006.01)
*C25C 3/14* (2006.01)

(52) U.S. Cl.
CPC . *C25C 3/20* (2013.01); *C25C 3/14* (2013.01)

(58) Field of Classification Search
CPC ..... C25C 3/20
(Continued)

(56) References Cited

U.S. PATENT DOCUMENTS 4,431,491 A * 2/1984 Bonny ..... C25C 3/20 204/245
4,639,304 A * 1/1987 Bader ..... G01N 27/4114 204/413

(Continued)

FOREIGN PATENT DOCUMENTS

RU 2220231 C2 12/2003
RU 2233914 C1 8/2004
RU 2496923 C2 10/2013

OTHER PUBLICATIONS

Lubyova et al, Solubility and Rate of Dissolution of Alumina in Cryolite-Based AlF3-Rich Melts with Additions of LiF, CaF2, and MgF2, Chemical Papers, Apr. 1993, vol. 47, No. 4, pp. 218-220 (Year: 1993).*

(Continued)

*Primary Examiner* — Harry D Wilkins, III
(74) *Attorney, Agent, or Firm* — Hogan Lovells US LLP

(57) ABSTRACT

The invention relates to nonferrous metallurgy and may be suitable for controlling the feed of alumina to electrolytic cells for producing aluminum to maintain the alumina concentration in the electrolytic melt equal or close to the saturation value. To maintain the alumina concentration within the set range, reduced voltage U or pseudo-resistance R is measured and recorded at fixed time intervals. Underfeeding or overfeeding phases occur compared to a theoretical alumina feeding rate during electrolysis, wherein the duration of underfeeding phases is based on the alumina concentration in the electrolytic melt, and the duration of overfeeding phases is based on the change of one or more electrolytic cell parameters being recorded: reduced voltage, (Continued)

U, pseudo-resistance, R, rates of reduced voltage, dU/dt, pseudo-resistance, dR/dt, change. Adjustments to the anode-cathode distance to maintain the electrolytic cell energy balance may be performed during any of the feeding phases.

14 Claims, 4 Drawing Sheets

(58) Field of Classification Search
USPC ..... 205/389, 336
See application file for complete search history.

(56) References Cited

U.S. PATENT DOCUMENTS

| | | | | |
|---|---|---|---|---|
| 4,654,130 | A * | 3/1987 | Tabereaux | C25C 3/20 205/336 |
| 6,033,550 | A | 3/2000 | Bonnardel et al. | |
| 6,126,809 | A * | 10/2000 | Larsen | C25C 3/20 205/336 |
| 6,609,119 | B1 | 8/2003 | Meghlaoui | |
| 2005/0247568 | A1 * | 11/2005 | Svoevskiy | C25C 3/20 205/336 |
| 2011/0094891 | A1 * | 4/2011 | Fardeau | C25C 3/20 205/336 |

OTHER PUBLICATIONS

International Search Report for PCT/RUS2014/000443 dated Mar. 5, 2015.

* cited by examiner

METHOD FOR CONTROLLING AN ALUMINA FEED TO ELECTROLYTIC CELLS FOR PRODUCING ALUMINUM

The invention relates to nonferrous metallurgy, in particular to a method for controlling a feed of alumina to electrolytic cells to maintain an alumina concentration in an electrolytic melt equal or close to a saturation value for an electrolytic aluminum production from molten salts.

Currently, aluminum is produced in cells by electrolytic reduction of alumina in molten fluorides at a temperature of circa 950° C. The aluminum oxide concentration in the electrolytic melt is maintained as 2-4 wt. % which reduces a risk of deposition and buildup of alumina sludge on the cell bottom.

There are a number of methods for controlling the feed of alumina to a cell with the alumina concentration significantly below the saturation value; these methods use a changing relationship between the electric resistance or voltage in a cell and aluminum oxide concentration in electrolyte while alternating periods of alumina underfeed and overfeed to a cell. According to this relationship, any change of the alumina concentration in the electrolyte leads to a change of voltage (pseudo-resistance) in the cell with all other electrolysis parameters remaining constant. The alumina concentration in electrolyte may be deduced from the rate of a voltage (pseudo-resistance) change.

Figure 1:
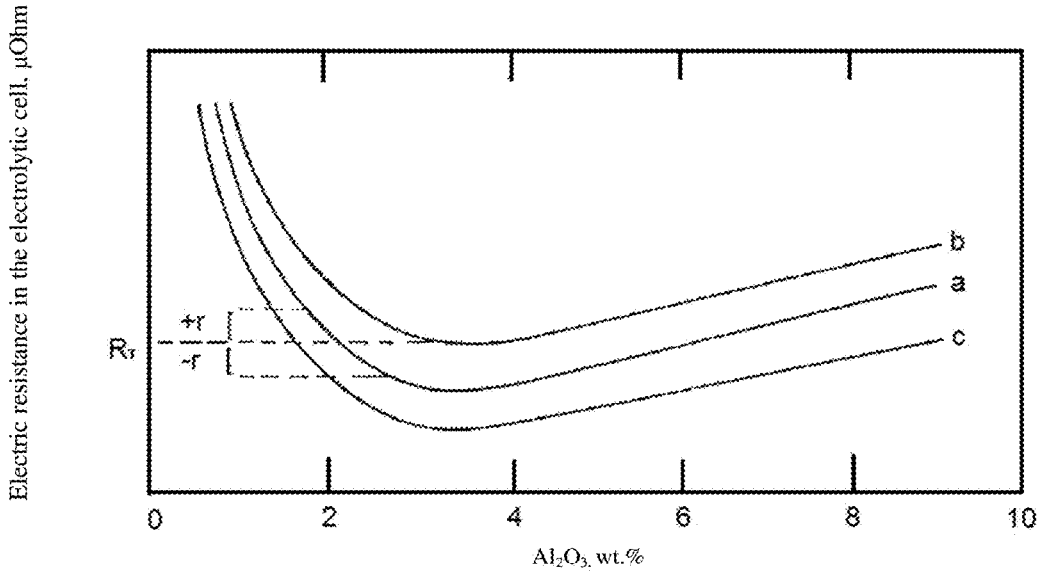

FIG. 1 shows the electric resistance versus the alumina concentration in the melt with different anodecathode distance (ACD), where (a) is an optimum ACD, (b) is a large ACD, and (c) is a small ACD. In the industry practice, the electric resistance in a cell is maintained in the range of $R_m$−r to $R_m$+r, where $R_m$ is a target resistance value. The figure shows that the relationship is non-linear and the minimum resistance corresponds to approximately 4 wt % alumina in the melt. The growing electric resistance in the low range of alumina concentration (the left part, or left branch of the curve) indicates a drop of the aluminum oxide concentration in an electrolytic melt and the oncoming anodic effect, whereas the growing resistance in the high range of alumina concentrations (the right part, or right branch of the curve) indicates the alumina concentration buildup. Moreover, FIG. 1 shows that the change in alumina concentration in a low-alumina melt produces a higher rate of voltage and pseudo-resistance change than in high-alumina melts, i.e. the voltage and pseudo-resistance have a higher sensitivity to alumina, when the alumina concentration is low. Therefore, the alumina concentration in the electrolytic melt is maintained between 2 and 4 wt. %, and such values simplify the algorithm of the automated feed control. Furthermore, the risk of deposition of the alumina sludge in the bottom of the cell is lower.

For example, the above relationship between the reduced cell voltage and the aluminum oxide concentration in the electrolytic cell provides grounds for the method of controlling the electrolytic cell, while the rate of alumina dissolution changes (RU patent No. 2255149, C25C3/20, of 2004 May 5); the method includes maintaining an alumina concentration within a set range by alternating the feed modes (standard feeding, underfeeding, and overfeeding), measuring the electrolytic cell voltage, potline current, calculating the reduced voltage, $U_{red}$, rate of its change in time, $dU_{red}/dt$, and comparing the calculated and set values. This method can adapt the feed algorithm to the feed quality, alumina dissolution rate, operating parameters of electrolysis, and automated alumina feeding modes.

Any deviation from the target parameters is detected by plotting the doses of an automated alumina feed in the underfeeding and overfeeding modes on the Shewhart chart. The alumina doses are compared with the target range and then adjusted by changing the basic constants of the operating modes of the automated alumina feeding system, voltage setting, and adding aluminum fluoride to the cell.

A disadvantage of this method is that, in case of the electrolytic cell malfunction, the feed algorithm has to be periodically manually adjusted to the Shewhart chart with the time interval between measurements of the alumina doses being set to at least 24 hours. Accordingly, it is likely that the electrolytic cell operates for a considerably long time with the underfeeding or overfeeding, which may result in an increased number of process faults lower electrolytic cell performance (higher specific power consumption, lower cell efficiency, and higher labor costs).

Also known is a method for controlling the feed of alumina to electrolytic cells for producing aluminum (RU patent No. 2233914, C25C3/20, of 2004 Aug. 10), when an electrolytic cell voltage is measured to form a sequence of the standard feeding, underfeeding, and overfeeding modes for maintaining the alumina concentration in the set range. Pseudo-resistance, $R_{nc}$, and its time derivative, $dR_{nc}/dt$, are calculated based on the measurements of the electrolytic cell voltage and potline current, and if $dR_{nc}/dt$ exceeds the set threshold during the underfeeding mode, this mode switches to the overfeeding mode. The periods of the automated alumina feed in the underfeeding and overfeeding modes are set proportionally to the automated alumina feed setting, whereas the anode assembly is be moved only during the basic feeding mode. The automated alumina feed setting is adjusted to the duration of the underfeeding mode: if the underfeeding mode lasts more than the set time, the automated alumina feed setting is increased and vice versa, whereas the overfeeding mode has a constant time.

This method also depends on the relationship between the electrolytic cell voltage (pseudo-resistance) and the alumina concentration in the electrolytic melt. A disadvantage of the method is in the impossibility of increasing the electrolytic cell pseudo-resistance when the alumina concentration exceeds a certain limit, i.e. it refers to the right part of the curve of the electrolytic cell voltage (pseudo-resistance) versus the alumina concentration in the electrolytic melt. The higher pseudo-resistance leads to a malfunction of the automated alumina feeding system, namely to the superfluous feeding during the overfeeding mode and cell overfeeding and deposition of alumina sludge in the cell bottom.

The closest analog to the method of the present disclosure in terms of its technical essence and technical effect is the method for controlling the feed of alumina to electrolytic cells (RU Patent No. 2220231, C25C3/20, of 2005 Dec. 27) that measures the resistance between the electrodes in the electrolytic cell, records resistance at fixed time intervals, evaluates the aluminum oxide concentration in the electrolytic cell, and provides aluminum oxide under or overfeed to the cell at a fixed rate. This method uses cumulative information about the resistance curve trend over the feeding phases including underfeeding and overfeeding. The aluminum oxide concentration in the electrolytic melt is deduced from the trend and slope angle of the resistance curve during transition from under to overfeeding. A descending part of the resistance curve indicates a lower concentration of aluminum oxide in the electrolytic melt, an ascending part of the curve indicates a higher concentration; a concentration circa 4% produces a flat or nearly flat curve. To maintain the optimum range of the aluminum oxide concentration in a cell a decision on duration of the under and overfeed to the cell during the next feed phase is made based on the parameters of a previous cycle.

A disadvantage of this method, as well as of the above methods, is that it can be applied exclusively when the alumina concentration is relatively low (in the range of 2 to 4 wt. %). In this case, the left part of the curve of the electrolytic cell voltage versus alumina concentration in the electrolytic melt applies to the process (FIG. 1). A higher alumina concentration in the electrolytic melt and transition of the process to the right part of the curve, i.e. to the area of higher alumina concentrations, is considered, in terms of the above methods, as a process fault. Therefore, these methods for controlling the alumina feed are inapplicable, when we need to maintain the alumina concentration in the electrolytic melt as equal or close to the saturation value.

At the same time, the use of melts saturated with aluminum oxide can completely eliminate anode effects and make it possible to use inert anodes and aluminum-oxide-based refractory lining. Currently, no methods are available for automatic alumina feed to electrolytic cells with maintaining the alumina concentration in the electrolytic melt close to the alumina solubility limit.

The aim of this invention is the elimination of anode effects in electrolytic cells with carbon anodes, as well as slowing down the corrosion rate of inert anodes and aluminum-oxide-based lining materials.

The technical effect is reduction of the alumina sludge in the cell bottom by using an electrolytic melt saturated or almost saturated with aluminum oxide.

The technical effect is achieved by providing a method for controlling an alumina feed to an electrolytic cell for producing aluminum from molten salts. The method comprises measuring a resistance value between electrodes of the electrolytic cell; recording measured resistance values at fixed time intervals;

evaluating an alumina concentration; feeding the alumina at a set rate in underfeeding modes and overfeeding modes compared with a theoretical alumina feeding rate, alternating phases of underfeeding and overfeeding, maintaining the alumina concentration in an electrolytic melt is equal or close to a saturation value, wherein a duration of the underfeeding phases is selected depending on the alumina concentration in the electrolytic melt, and a duration of overfeeding phases is determined according to the change of one or more electrolytic cell parameters being recorded: reduced voltage, U, pseudo-resistance, R, rates of reduced voltage, dU/dt and pseudo-resistance, dR/dt, and wherein an anode-cathode distance is adjusted during any of the feeding phases by displacing an anode assembly.

Particular embodiments of the method for controlling the feed of alumina to the electrolytic cell have the following features:

1. In the underfeeding phase, a relative alumina feeding rate, $V_1$, is set in the range of 0-80% of a theoretical alumina feeding rate during electrolysis.

2. In the overfeeding phase, a relative alumina feeding rate, $V_2$, is set in the range of 110-400% of a theoretical alumina feeding rate during electrolysis.

3. A feed cycle, i, consisting of an underfeeding phase having a duration of $\tau_1$ and a overfeeding phase having a duration of $\tau_2$, starts with an underfeeding phase followed by an overfeeding phase, whereas the first reduced voltage value, $U_{initial}$, is recorded in the overfeeding phase and the overfeeding phase is terminated if:

$$(dU/dt)>k_1, \text{ where}$$

$k_1$ is a threshold value of the rate of reduced voltage change in the overfeeding phase; or $$U>U_{initial}+\Delta U \text{ in time } \tau_x, \text{ where}$$

ΔU is a threshold value of reduced voltage change in the overfeeding phase; or $$\tau_2>\tau_1(V_{max}-V_1)/(V_2-V_{max}), \text{ where}$$

$V_{max}$ is a maximum alumina feeding rate determining the longest overfeeding phase duration.

4. At the beginning of the overfeeding phase, the first pseudo-resistance value, $R_{initial}$, is recorded, whereas the overfeeding phase is terminated if:

$$(dR/dt)>k_2, \text{ where}$$

$k_2$ is a threshold value of the rate of pseudo-resistance change in the overfeeding phase; or $$R>R_{initial}+\Delta R \text{ in time } \tau_x, \text{ where}$$

ΔR is a threshold value of pseudo-resistance change in the overfeeding phase; or $$\tau_2>\tau_1(V_{max}-V_1)/(V_2-V_{max}).$$

5. At the beginning of the overfeeding phase, conditions for termination of the overfeeding phase are checked once the following condition has been met:

$$\tau_2\geq\tau_1(V_{min}-V_1)/(V_2-V_{min}),$$

where $V_{min}$ is a minimum alumina feeding rate determining the shortest duration of the overfeeding phase.

6. The duration $\tau_1$ of the underfeeding phase is selected such that transition to the overfeeding phase takes place, depending on the process requirements, once the aluminum oxide concentration in the electrolytic melt has decreased by 0.5-5 wt. % $Al_2O_3$ 7. Upon completion of the overfeeding phase, the value of $V_2$ for the overfeeding phase in the next cycle, i+1, is automatically adjusted in cycle i, if:

$$\tau_2>\tau_1((V+\Delta V)-V_1)/(V_2-(V+\Delta V)) \text{ and } V_{2(i)}+\Delta V<400\%, \text{ then } V_{2(i+1)}=V_{2(i)}+\Delta V; \text{ or}$$

$$\tau_2<\tau_1((V-\Delta V)-V_1)/(V_2-(V-\Delta V)) \text{ and } V_{2(i)}-\Delta V>110\%, \text{ then } V_{2(i+1)}=V_{2(i)}-\Delta V,$$

where V is a nominal value of the alumina feeding rate in the electrolytic cell close to an actual value;

ΔV is a non-sensitive zone for adjustment of parameters $V_2$, ΔU and ΔR.

8. Upon completion of the overfeeding phase, the value of ΔU for the overfeeding phase in the next cycle i+1 is automatically adjusted to cycle i, if:

$$\tau_2>\tau^1((V+\Delta V)-V_1)/(V_2-(V+\Delta V)) \text{ and } \Delta U_i-u>\Delta U_{min}, \text{ then } \Delta U_{i+1}=\Delta U_i-u; \text{ or}$$

$$\tau_2<\tau^1((V-\Delta V)-V_1)/(V_2-(V-\Delta V)) \text{ and } \Delta U_i+u<\Delta U_{max}, \text{ then } \Delta U_{i+1}=\tau U_i+u,$$

where u is an increment of parameter ΔU adjustment;

$\Delta U_{min}$ is a minimum value of parameter ΔU;

$\Delta U_{max}$ is a maximum value of parameter ΔU.

9. Upon completion of the overfeeding phase, the value ΔR for the overfeeding phase in next cycle i+1 is automatically adjusted to cycle i, if:

$$\tau_2>\tau_1((V+\Delta V)-V_1)/(V_2-(V+\Delta V)) \text{ and } \Delta R_i-r>\Delta R_{min}, \text{ then } \Delta R_{i+1}=\Delta R_i-r; \text{ or}$$

$$\tau_2<\tau_1((V-\Delta V)-V_1)/(V_2-(V-\Delta V)) \text{ и } \Delta R_i+r<\Delta R_{max}, \text{ then } \Delta R_{i+1}=\Delta R_i+r,$$

where r is an increment of parameter ΔR adjustment;

$\Delta R_{min}$ is a minimum value of parameter $\Delta R$;

$\Delta R_{max}$ is a maximum value of parameter $\Delta R$.

10. When displacing the anode assembly during the overfeeding phase, the displacement is completed with an automatic adjustment of the first reduced voltage, $U_{initial}$, in the overfeeding phase or the first pseudo-resistance value, $R_{initial}$, depending on the parameter to be controlled:

$$U_{initial}=U_{initial}+(U_2-U_1), \text{ or}$$

$$R_{initial}=R_{initial}+(R_2-R_1),$$

where $U_1$ and $U_2$ are the reduced voltage values, respectively before and after the anode assembly displacement; $R_1$ and $R_2$ are the pseudo-resistance values, respectively before and after the anode assembly displacement.

The essence of the method of the present disclosure is in the following: feed cycle i that consists of a underfeeding phase having a duration of $\tau_1$ and an overfeeding phase having a duration of $\tau_2$ starts with the underfeeding phase followed by the overfeeding phase. A relative alumina feeding rate, $V_1$, in the underfeeding phase is set lower than a theoretical alumina feeding rate during electrolysis. A relative alumina feeding rate, $V_2$, in the overfeeding phase is set higher than a theoretical alumina feeding rate during electrolysis.

Duration $\tau_1$ of the underfeeding phase is selected such that transition to the overfeeding phase takes place, depending on the process requirements, after the aluminum oxide concentration in the electrolytic melt decreases by 0.5-5 wt. % $Al_2O_3$. When concentration of aluminum oxide falls by less than 0.5% during the underfeeding phase, it is impossible to avoid deposition of an alumina sludge during the overfeeding phase. When concentration of aluminum oxide falls by more than 5%, a risk of anode effects appears in electrolytic cells with carbon anodes; also appears a risk of corrosion of inert anodes, aluminum-oxide-based lining, and the electrolytic cell structure.

Relative alumina feeding rates in the under and overfeeding phases are set respectively in the ranges of 0-80% and 110-400% of a theoretical alumina feeding rate. In the underfeeding phase, an alumina feeding rate higher than 80% is impractical, as it results in an unreasonably long time for dropping the aluminum oxide concentration by 0.5-5%. An alumina feeding rate below 110% or over 400% results in deposition of an alumina sludge in the electrolytic cell bottom.

Depending on the controlled parameter, the duration of the overfeeding phase is determined by the following conditions:

1. The rate of reduced voltage or pseudo-resistance change is above the threshold value, $(dU/dt)>k_1$ or $(dR/dt)>k_2$, where $k_1$ and $k_2$ are the respective threshold values of the rate of reduced voltage and pseudo-resistance change in the overfeeding phase;

2. The value of reduced voltage or pseudo-resistance in time $\tau_x$ is above the threshold value $U>U_{initial}+\Delta U$ or $R>R_{initial}+\Delta R$, where $U_{initial}$ and $R_{initial}$ are the first respective values of reduced voltage and pseudo-resistance in the overfeeding phase; $\Delta U$ and $\Delta R$ are the respective threshold change values of voltage and pseudo-resistance in the overfeeding phase;

3. The duration of the overfeeding phase is above the maximum acceptable value $\tau_2>\tau_1(V_{max}-V_1)/(V_2-V_{max})$, where $V_{max}$ is a maximum alumina feeding rate determining the maximum duration of the overfeeding phase.

The values of $k_1$, $k_2$, $\tau_x$, $\Delta U$, $\Delta R$, $V_{max}$, and $V_{min}$, are selected empirically depending on the process characteristics.

In the method of the present disclosure, a protective period for the alumina feed exists at the beginning of the overfeeding phase, during which the conditions for termination of this phase cannot be checked. The conditions for termination of the overfeeding phase are to be only checked under the following condition:

$$\tau_2 \geq \tau_1(V_{min}-V_1)/(V_2-V_{min}),$$

where $V_{min}$ is a minimum alumina feeding rate determining the shortest duration of the overfeeding phase.

Therefore, loading of a certain amount of alumina to the electrolytic cell may be provided in case of incorrect fulfillment of conditions for termination at the very beginning of the overfeeding phase, caused by accidental and unsystematic interventions to the electrolytic cell operation.

When changing the electrolysis parameters (current efficiency, electrolysis temperature, electrolytic melt composition) and characteristics of the automated alumina feeder (dose weight), the method of the present disclosure provides for three automatic adjustment options:

1. Adjustment of the alumina feeding rate in the overfeeding phase, $V_2$,

2. Adjustment of parameter $\Delta U$ to meet the condition for termination of the overfeeding phase, 3. Adjustment of parameter $\Delta R$ to meet the condition for termination of the overfeeding phase.

The purpose of these adjustments is to select the values of parameters $V_2$, $\Delta U$, and $\Delta R$ so that a dynamic balance between the alumina feed and consumption in the electrolytic cell is established during the feed cycle. The target range of duration of the overfeeding phase is determined according to the following expression:

$$\tau_1((V-\Delta V)-V_1)/(V_2-(V-\Delta V))<\tau_2<\tau_1((V+\Delta V)-V_1)/(V_2-(V+\Delta V)),$$

where V is a nominal value of the alumina feeding rate in the electrolytic cell close to an actual value, $\Delta V$ is a non-sensitive zone for adjustment of parameters $V_2$, $\Delta U$ and $\Delta R$.

Overrunning the target range is accompanied by alarming and adjusting one of the above three parameters, which ultimately result in a required change of the overfeeding phase duration. The adjustment to be done gradually because the duration of the underfeeding phase may be affected by accidental and unsystematic interventions in the electrolytic cell operation.

Figure 2:
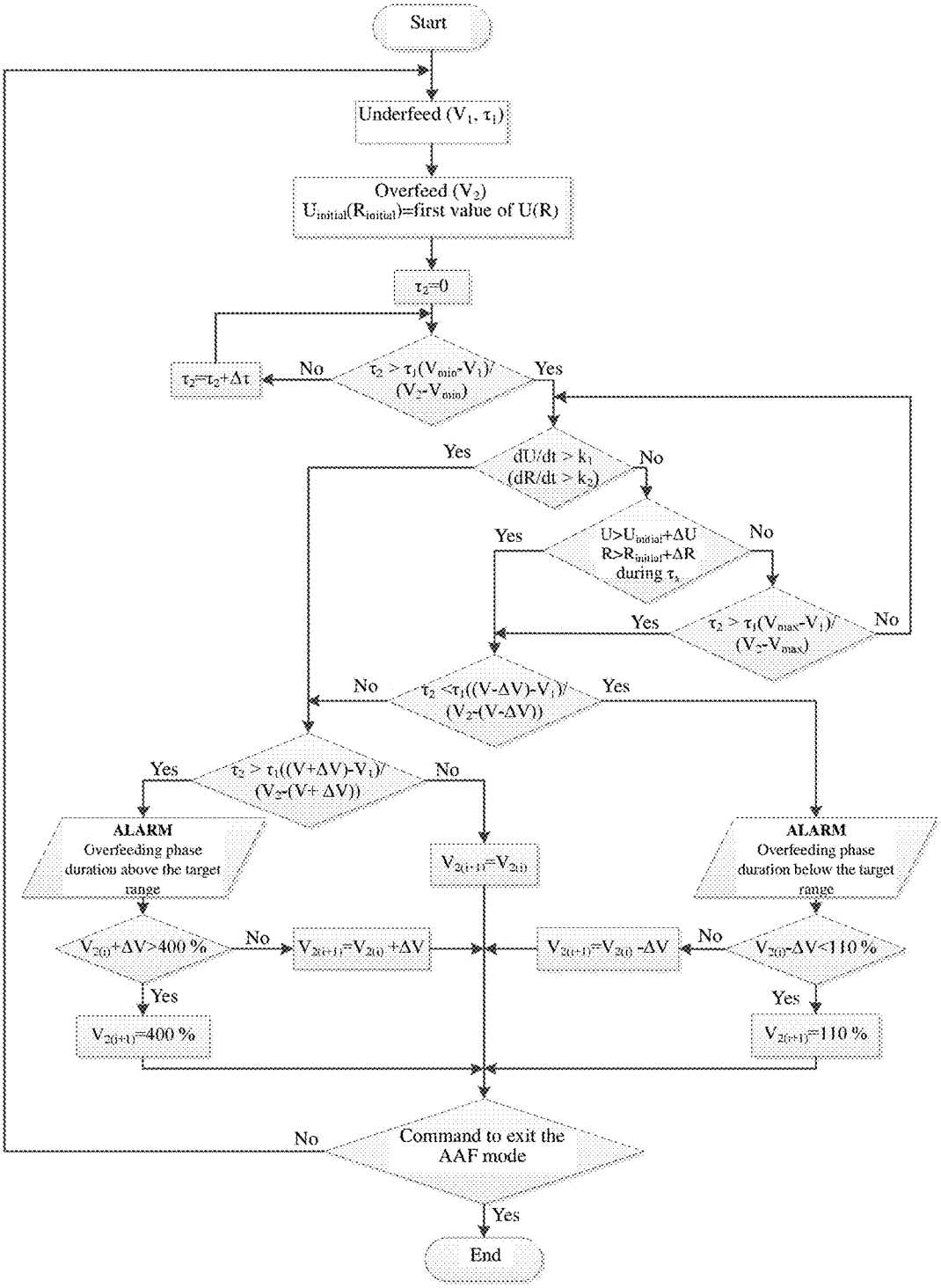
Figure 3:
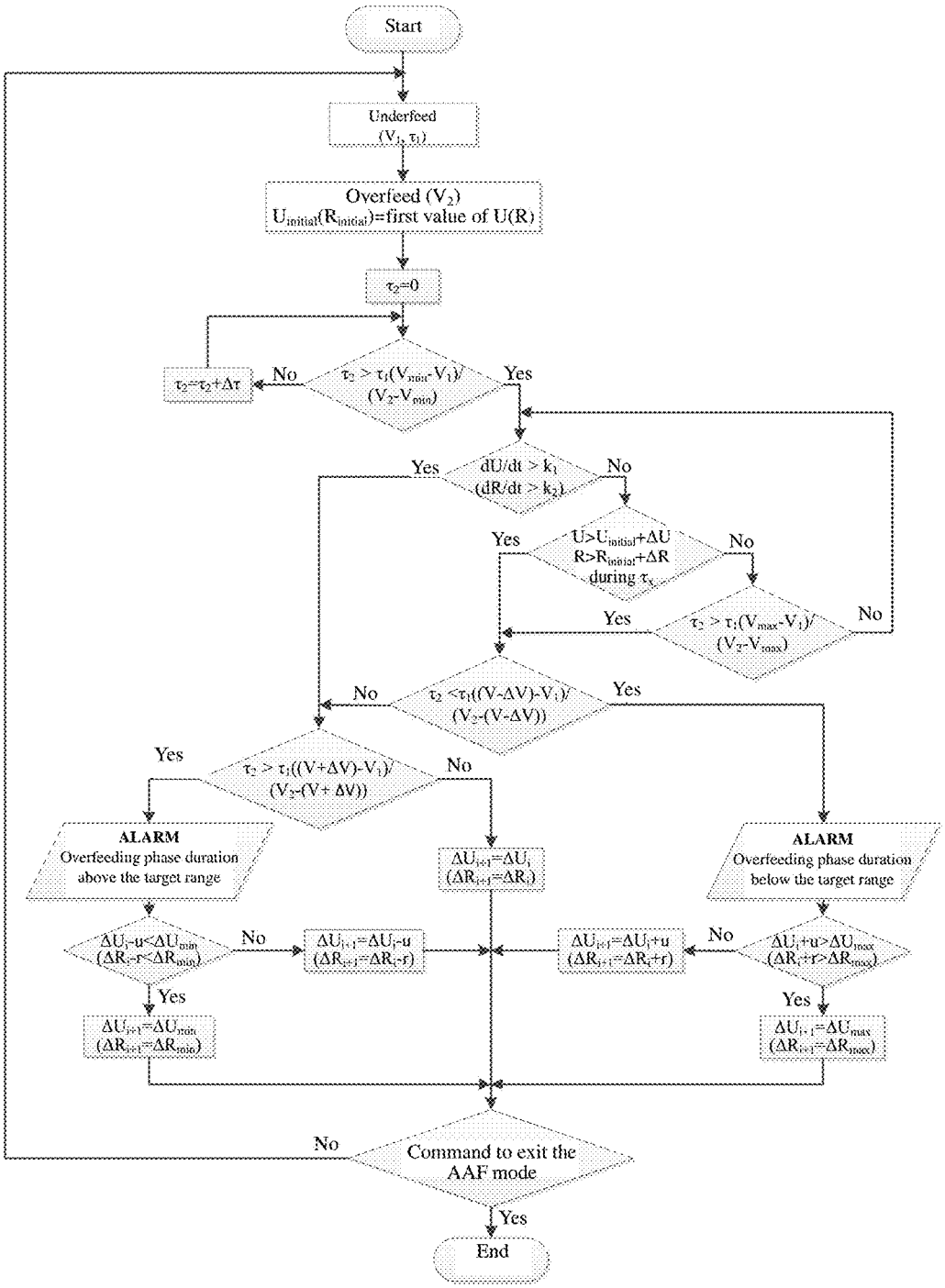
Figure 4:
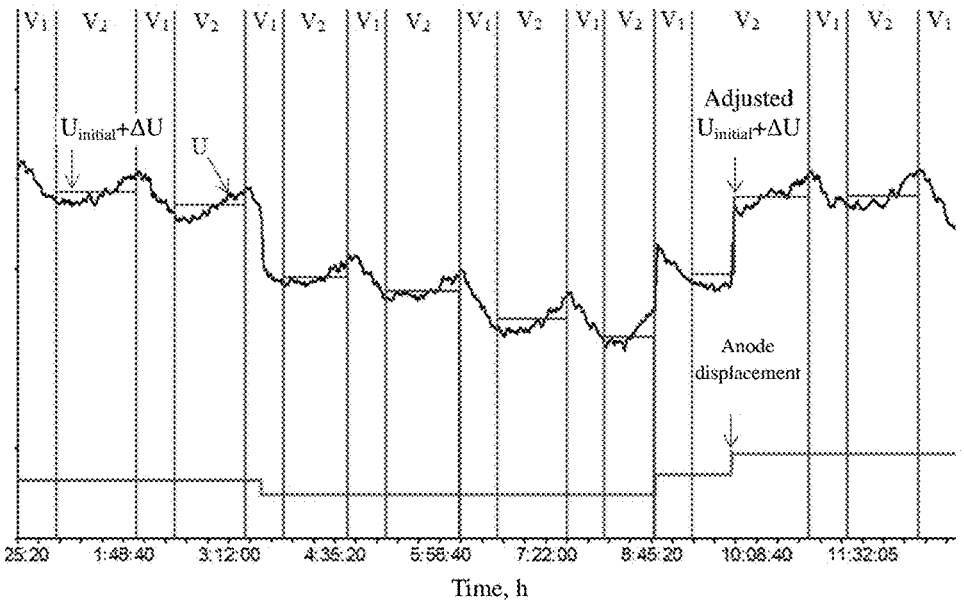

FIGS. 2, 3, and 4 exemplify embodiments of the method.

When the adjustment of the alumina feeding rate is selected as shown in FIG. 2, the selected control, upon completion of the overfeeding phase in cycle i, automatically adjusts $V_2$ for the overfeeding phase of next cycle i+1:

If duration of the overfeeding phase is within the target range, no adjustment is applied, If duration of the overfeeding phase is above the target range $\tau_2>\tau_1((V+\Delta V)-V_1)/(V_2-(V+\Delta V))$, and if $V_{2(i)}+\Delta V<400\%$, the alumina feeding rate increases by a value of the non-sensitive zone $V_{2(i+1)}=V_{2(i)}+\Delta V$, If duration of the overfeeding phase is below the target range $\tau_2<\tau_1((V-\Delta V)-V_1)/(V_2-(V-\Delta V))$, and if $V_{2(i)}-\Delta V>110\%$, the alumina feeding rate decreases by a value of the non-sensitive zone $V_{2(i+1)}=V_{2(i)}-\Delta V$.

When adjustment of parameter $\Delta U$ is selected as a condition for termination of the overfeeding phase, as FIG. 3 shows, then, upon completion of the overfeeding phase, the value of $\Delta U$ automatically adjusts to cycle i for the overfeeding phase in next cycle i+1:

If duration of the overfeeding phase is within the target range, no adjustment is required, If duration of the overfeeding phase is above the target range $\tau_2>\tau_1((V+\Delta V)-V_1)/(V_2-(V+\Delta V))$, and if $\Delta U_i-u>\Delta U_{min}$, parameter $\Delta U$ decreases by an increment of adjustment $\Delta U_{i+1}=\Delta U_i-u$, If duration of the overfeeding phase is below the target range $\tau_2<\tau_1((V-\Delta V)-V_1)/(V_2-(V-\Delta V))$, and if $\Delta U_i+u<\Delta U_{max}$, parameter $\Delta U$ increases by an increment of adjustment $\Delta U_{i+1}=\Delta U_i+u$, where u is an increment of adjustment of parameter $\Delta U$, $\Delta U_{min}$ is a minimum value of parameter $\Delta U$, $\Delta U_{max}$ is a maximum value of parameter $\Delta U$.

When the adjustment of parameter $\Delta U$ is selected as a condition for termination of the overfeeding phase, as FIG. 3 shows, upon completion of the overfeeding phase, the value of $\Delta R$ automatically adjusts to cycle i for the overfeeding phase in next cycle i+1:

If duration of the overfeeding phase is within the target range, no adjustment is required, If duration of the overfeeding phase is above the target range $\tau_2>\tau_1((V+\Delta V)-V_1)/(V_2-(V+\Delta V))$, and if $\Delta R_i-r>\Delta R_{min}$, parameter $\Delta R$ decreases by an increment of adjustment $\Delta R_{i+1}=\Delta R_i-r$, If duration of the overfeeding phase is below the target range $\tau_2<\tau_1((V-\Delta V)-V_1)/(V_2-(V-\Delta V))$, and if $\Delta R_i+r<\Delta R_{max}$, parameter $\Delta R$ increases by an increment of adjustment $\Delta R_{i+1}=\Delta R_i+r$, where r is an increment of adjustment of parameter $\Delta R$, $\Delta R_{min}$ is a minimum value of parameter $\Delta R$, $\Delta R_{max}$ is a maximum value of parameter $\Delta R$.

The values of V, $\Delta V$, u, $\Delta U_{min}$, $\Delta U_{max}$, r, $\Delta R_{min}$, and $\Delta R_{max}$ are selected empirically depending on the process characteristics.

If the automatic adjustment fails to bring the duration of the overfeeding phase back to the set range, this may be indicative of serious abnormalities in the electrolytic cell operation (reduced current efficiency, faulty operation of feeders of the automated alumina feed system, lower operating temperature).

Alternating the under and overfeeding phases provides an acceptable alumina dissolution rate in the electrolytic melt so that sludge is less likely to accumulate in the electrolytic cell bottom.

The method of the present disclosure provides two ways of adjusting the anode-cathode distance for maintaining the electrolytic cell energy balance.

According to the first case, the anode assembly is displaced only during the underfeeding phase because the duration of this phase is fixed and not dependent on the change of the electrolytic cell voltage or pseudo-resistance.

According to the second case, the anode assembly may be displaced both during the underfeeding phase and the overfeeding phase. In this case the ACD to be changed during the overfeeding phase:

The overfeeding phase is not terminated while the anode assembly displacement mechanism is engaged;

Once the operation of the anode assembly displacement mechanism is completed, the values of $U_{initial}$ or $R_{initial}$ automatically adjust to compensate the voltage change as a result of the ACD change depending on the controlled parameter:

$$U_{inital}=U_{initial}+(U_2-U_1), \text{ or}$$

$$R_{initial}=R_{initial}+(R_2-R_1)$$

where $U_1$ and $U_2$ are the reduced voltage values before and after the anode assembly displacement, respectively;

$R_1$ and $R_2$ are the pseudo-resistance values before and after the anode assembly displacement, respectively.

It should be noted that the method for controlling the feed of alumina is applicable only in case of a normal operation of the electrolytic cell and in the absence of any disturbances to the process (metal draining, anode replacement, change of the electrolytic cell space configuration), otherwise the controlled alumina feed stops and alumina is supplied at a rate of V selected empirically depending on the characteristics of the electrolytic process.

The method for controlling the feed of alumina to an electrolytic cell for producing aluminum is described in the example, whereas the feed process control is based on the change of reduced voltage in time depending on the feeding rate. The method is implemented with the following basic settings: $V_1$=0%, $V_2$=140%, $\tau_1$=30 [min], $V_{min}$=0%, $V_{max}$=105%, $k_1$=5 [mV/min], $\Delta U$=10 [mV], $\tau_x$=10 [min], V=95%, $\Delta V$=5%, $\Delta U_{min}$=0 [mV], $\Delta U_{max}$=30 [mV], u=2 [mV].

FIG. 4 shows the cyclic change of voltage depending on the alumina feeding rate, whereas the boundaries of the underfeeding phase ($V_1$) and overfeeding phase ($V_2$) are shown as vertical lines. Assuming the unchanged duration of the underfeeding phase at all cycles, the electrolytic cell voltage in this phase regularly decreases. In the overfeeding phases, on the contrary, the voltage increases, while the duration of the overfeeding phases changes from cycle to cycle depending on whether the appropriate condition for termination of the overfeeding phase is met, namely, if the reduced voltage is above the threshold $U_{initial}+\Delta U$.

FIG. 4 also shows an increase of the threshold $U_{initial}+\Delta U$ as the system response to the change of the electrolytic cell voltage with the increase of the anode-cathode distance.

No deposition of sludge in the electrolytic cell bottom was recorded while using the method of the present disclosure, whereas the aluminum oxide concentration in the electrolytic melt was maintained equal or close to the saturation value (5-6 wt. %) and the maximum drop of the aluminum oxide concentration in the electrolytic melt at the end of the underfeeding phase was not more than 1 wt. % $Al_2O_3$. This example demonstrates the efficiency of the method for controlling the alumina feed.

The comparative analysis performed by the Applicant has shown that the combination of features is novel, and the method itself meets all conditions of patentability.

The implementation of the method for controlling the feed of alumina to an electrolytic cell for aluminum production, in comparison with its prototypes, makes it possible to maintain the concentration of aluminum oxide in the electrolytic melt equal or close to the saturation value.

The invention claimed is:

1. A method for controlling a feed of alumina to an electrolytic cell for producing aluminum by electrolysis of a molten salt melt, the method comprising:

measuring a plurality of resistance values between electrodes of the electrolytic cell;

recording the measured resistance values at fixed time intervals;

evaluating an alumina concentration of the molten salt melt;

feeding the alumina at a set rate in underfeeding phases ($V_1$) and overfeeding phases ($V_2$) compared with a theoretical alumina feeding rate;

alternating the underfeeding phases and the overfeeding phases, wherein a pair of successive underfeeding and overfeeding phases makes a feeding cycle (i), such that the alumina concentration is maintained in a range from 5% below a saturation value to the saturation value, wherein a duration of the underfeeding phases is selected depending on the alumina concentration in the electrolytic melt, and wherein a duration of the overfeeding phases is determined by a change of one or more recorded electrolytic cell parameters selected from the group consisting of:

reduced voltage, (U), pseudo-resistance, (R), rate of change of reduced voltage, (dU/dt), and rate of change of pseudo-resistance, (dR/dt); and in a second feeding cycle (i+1) following a first feeding cycle (i), based on the duration of the overfeeding phase in the first feeding cycle (i), automatically adjusting one or more parameters selected the group consisting of:

the alumina feed rate in the overfeeding phase ($V_2$) for the second feeding cycle;

the change in reduced voltage ($\Delta U$) necessary to terminate the overfeeding phase in the second cycle; and the change in pseudo-resistance ($\Delta R$) necessary to terminate the overfeeding phase in the second cycle.

2. The method according to claim 1, wherein a relative alumina feeding rate $V_1$ in the underfeeding phase is set to a range of 0-80% of the theoretical alumina feeding rate.

3. The method according to claim 1, wherein a relative alumina feeding rate $V_2$ in the overfeeding phase is set to a range of 110-400% of the theoretical alumina feeding rate.

4. The method according to claim 1, wherein feed cycle i that consists of the underfeeding phase having a duration of $\tau_1$ and the overfeeding phase having a duration of $\tau_2$ starts with the underfeeding phase followed by the overfeeding phase, wherein a first reduced voltage, $U_{initial}$, is recorded in the overfeeding phase, and the overfeeding phase to be terminated in the following cases:

$(dU/dt)>k_1$, where $k_1$ is a threshold value of a rate of the reduced voltage change in the overfeeding phase;

or $U>U_{initial}+\Delta U$ in $\tau_x$; or $\tau_2>\tau_1\ (V_{max}-V_1)/(V_2-V_{max})$, where $V_{max}$ is a maximum alumina feeding rate determining the longest duration of the overfeeding phase.

5. The method according to claim 4, wherein a first pseudo-resistance value, $R_{initial}$, is recorded at the beginning of the overfeeding phase, wherein the overfeeding phase to be terminated in the following cases:

$(dR/dt)>k_2$, where $k_2$ is a threshold value of a rate of pseudo-resistance change in the overfeeding phase;

or $R>R_{initial}+\Delta R$ in time $\tau_x$; or $\tau_2>\tau_1(V_{max}-V_1)/(V_2-V_{max})$.

6. The method, according to claim 5, wherein the value of $\Delta R$, which, upon completion of the overfeeding phase, automatically adjusts the overfeeding phase of cycle i+1 relative to that of cycle i if:

$\tau_2>\tau_1((V+\Delta V)-V_1)/(V_2-(V+\Delta V))$ and $\Delta R_i-r>\Delta R_{min}$, then $\Delta R_{i+1}=\Delta R_i-r$; or $\tau_2<\tau_1((V-\Delta V)-V_1)/(V_2-(V-\Delta V))$ and $\Delta R_i+r<\Delta R_{max}$, then $\Delta R_{i+1}=\Delta R_i+r$;

where r is an increment of adjustment of parameter $\Delta R$, $\Delta R_{min}$ is a minimum value of parameter $\Delta R$, $\Delta R_{max}$ is a maximum value of parameter $\Delta R$.

7. The method according to claim 5, wherein the duration of $\tau_1$ of the underfeeding phase is selected so that the transition to the overfeeding phase, depending on the process requirements, occurs when the alumina concentration in the electrolytic melt reduces by 0.5-5 wt. % $Al_2O_3$.

8. The method according to claim 5, wherein the first pseudo-resistance value, $R_{initial}$, is automatically adjusted upon completion of the displacement of the anode assembly in the overfeeding phase:

$R_{initial}=R_{initial}+(R_2-R_1)$, $R_1$ and $R_2$ are the pseudo-resistance values before and after the displacement of the anode assembly, respectively.

9. The method according to claim 4, wherein the value of $V_2$, which, upon completion of the overfeeding phase, automatically adjusts the overfeeding phase of cycle i+1 relative to that of cycle i if:

$\tau_2>\tau_1((V+\Delta V)-V_1)/(V_2-(V+\Delta V))$ and $V_{2(i)}+\Delta V<400\%$, then $V_{2(i+1)}=V_{2(i)}+\Delta V$; or $\tau_2<\tau_1((V-\Delta V)-V_1)/(V_2-(V-\Delta V))$ and $V_{2(i)}-\Delta V>110\%$, then $V_{2(i+1)}=V_{2(i)}-\Delta V$, where V is a nominal value of the alumina feeding rate in the electrolytic cell, which is close to the actual value;

$\Delta V$ is a non-sensitive zone for the adjustment of parameters $V_2$, $\Delta U$ and $\Delta R$.

10. The method according to claim 4, wherein the value of $\Delta U$, which, upon completion of the overfeeding phase, automatically adjusts the overfeeding phase of cycle i+1 relative to that of cycle i if:

$\tau_2>\tau_1((V+\Delta V)-V_1)/(V_2-(V+\Delta V))$ and $\Delta U_i-u>\Delta U_{min}$, then $\Delta U_{i+1}=\Delta U_i-u$; or $\tau_2<\tau_1((V-\Delta V)-V_1)/(V_2-(V-\Delta V))$ and $\Delta U_i+u<\Delta U_{max}$, then $\Delta U_{i+1}=\Delta U_i+u$, where u is an increment of adjustment of parameter $\Delta U$;

$\Delta U_{min}$ is a minimum value of parameter $\Delta U$;

$\Delta U_{max}$ is a maximum value of parameter $\Delta U$.

11. The method according to claim 4, wherein conditions for termination of the overfeeding phase are checked at the beginning of the overfeeding phase, once the following condition has been met:

$\tau_2\geq\tau_1(V_{min}-V_1)/(V_2-V_{min})$, where $V_{min}$ is the minimum alumina feed rate determining the shortest duration of the overfeeding phase.

12. The method according to claim 4, wherein a first reduced voltage, $U_{initial}$, in the overfeeding phase is automatically adjusted upon completion of the displacement of the anode assembly in the overfeeding phase:

$U_{initial}=U_{initial}+(U_2-U_1)$ where $U_1$ and $U_2$ are the reduced voltage values before and after the displacement of the anode assembly, respectively.

13. The method according to claim 1, wherein the electrolytic cell comprises an anode assembly and a cathode assembly, and the distance between the anode assembly and cathode assembly is an anode-cathode distance, the method further comprising the step of adjusting the anode-cathode distance during any of the feeding phases by displacing the anode assembly.

14. A method for controlling a feed of alumina to an electrolytic cell for producing aluminum by electrolysis of molten salts, the method comprising:

measuring a resistance value between electrodes of the electrolytic cell;

recording measured resistance values at fixed time intervals;

evaluating an alumina concentration of the molten salt;

feeding the alumina at a set rate in underfeeding phases ($V_1$) and overfeeding phases ($V_2$) compared with a theoretical alumina feeding rate;

alternating the underfeeding phases and the overfeeding phases, wherein a pair of successive underfeeding and overfeeding phases making a feeding cycle (i), wherein a duration of the underfeeding phases is selected depending on the alumina concentration in the electrolytic melt, and wherein a duration of the overfeeding phases is determined by a change of one or more recorded electrolytic cell parameters selected from the group consisting of:

reduced voltage, (U), pseudo-resistance, (R), rates of change of reduced voltage, (dU/dt), and rates of change of pseudo-resistance, (dR/dt); and in a second feeding cycle (i+1) following a first feeding cycle (i), based on the duration of the overfeeding phase in the first feeding cycle (i), automatically adjusting one or more parameters selected the group consisting of:

the alumina feed rate in the overfeeding phase ($V_2$) for the second feeding cycle;

the change in reduced voltage ($\Delta U$) necessary to terminate the overfeeding phase in the second cycle; and the change in pseudo-resistance ($\Delta R$) necessary to terminate the overfeeding phase in the second cycle;

wherein the electrolytic cell comprises an anode assembly and a cathode assembly, and the distance between the anode assembly and cathode assembly is an anode-cathode distance;

adjusting the anode-cathode distance during any of the feeding phases by displacing the anode assembly.

* * * * *